US005355819A

United States Patent [19]

Hsia et al.

[11] Patent Number: 5,355,819

[45] Date of Patent: Oct. 18, 1994

[54] METHODS OF TRANSPORTING LOW DENSITY LIQUIDS ACROSS OCEANS

[76] Inventors: Chih-Hung Hsia; Chih-Yu Hsia, both of 210 W. Las Tunas Dr., Arcadia, Calif. 91006

[21] Appl. No.: 9,222

[22] Filed: Jan. 26, 1993

[51] Int. Cl.[5] ..... B63B 25/12

[52] U.S. Cl. ..... 114/74 R; 114/242

[58] Field of Search ..... 114/74 R, 256, 74 T, 114/242; 141/279, 281, 250

[56] References Cited

U.S. PATENT DOCUMENTS

| | | | |
|---|---|---|---|
| 3,067,712 | 12/1962 | Doerpinghaus | 114/74 T |
| 3,779,196 | 12/1973 | Knaus et al. | 114/74 T |
| 4,399,765 | 8/1983 | Alkner et al. | 114/74 T |

FOREIGN PATENT DOCUMENTS

| | | | |
|---|---|---|---|
| 0730652 | 5/1955 | Russian Federation | 114/747 |
| 837668 | 6/1960 | United Kingdom | 114/745 |

*Primary Examiner*—Sherman Basinger

*Attorney, Agent, or Firm*—William W. Haefliger

[57] ABSTRACT

Low density liquids are filled into bags with or without assistance of filling floats which are floating docks with bag chambers on the tops. The bags will float and can be transported across oceans alone or together by sea currents or by towing. The bags can be drained by pumping or by using draining floats and draining towers. The draining floats are floating docks with bag chambers on the tops. The draining towers are structures for transporting drained liquids onto shores though liquids conveying systems.

4 Claims, 11 Drawing Sheets

METHODS OF TRANSPORTING LOW DENSITY LIQUIDS ACROSS OCEANS

BACKGROUND OF THE INVENTION

1. Field Of The Invention

This invention relates to methods of transport low density liquids which are lighter than sea water to cross open seas.

2. Statement Of Prior Arts

No prior art related to this invention is known to applicant.

SUMMARY OF THE INVENTION

This invention is based on the fact that low density liquids, such as fresh water, are lighter than sea water. When low density liquid is contained in a light weight bag, the bag of low density liquid will float on the sea. The walls of the bag will keep the low density liquid from mixing with the sea water. Since the unit weight of the low density liquid is only slightly lower than that of the sea water, the top of that light weight bag which is filled with low density liquid will float at a level very close to the sea water surface. (The net buoyancy of the bag determines whether the top of that bag will be above or under the sea water surface.) This bag of liquid will float harmonically with sea waves. Because of the flexibility and floatability of the bag of low density liquid, the hydrodynamic forces normally acting on an ordinary floating body, such as a ship, will not be significant to the bag. While the bag is floating in the sea, its weight will be supported by the sea water. The bag material therefore will not be subjected to high stresses. The integrity of the bag will remain while it is in sea. During its filling or draining, the bag's weight can be supported by specially designed floats. These floats can be ballasted or de-ballasted. Ballasting the float used for filling the bag will separate it from the filled bag because it will sink and the bag inside the float will float. When the bag is in the float used for draining, de-ballasting it will raise the bag above sea water surface therefore cause the bag to be separated from the sea water. De-ballasting the float used for draining will also help to drain the bag. Liquid which is drained from the bag will pass through a structure and eventually be conveyed onto land.

The transportation of the floated bag can be done by towing with boats, by floating with sea currents, or by combination of both. The floated bag can be transported in a bundle or alone. A net can be put on to strengthen the bag as will be seen.

DETAILED DESCRIPTIONS

The descriptions of the methods will be followed by the descriptions of the components and elements shown in the figures. Since many of the components and elements shown in different figures are common to each other, their reference numbers will not be called out again when their intended representations become obvious. For an example, the sea water surface is illustrated as a wiggled line and numbered as 100 in FIG. 1 but is not called out nor identified by any indicating number in any other figures.

Figure 1:
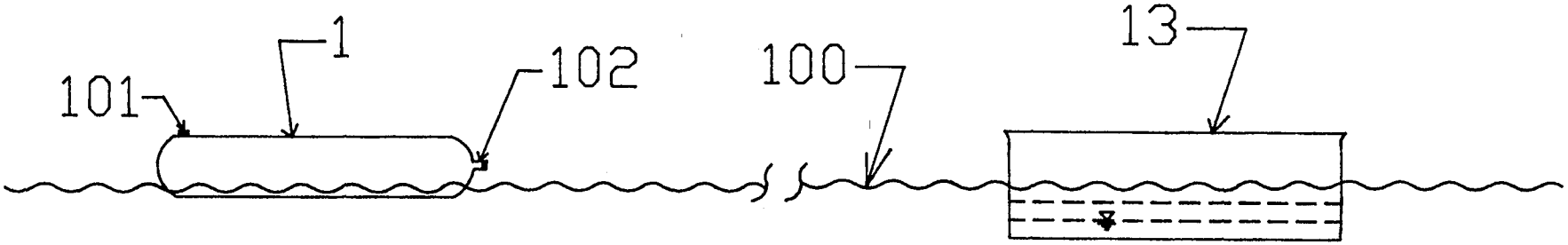
FIG. 1 shows the front views of two of the major components for the invented method at the initial stage.
Figure 18:
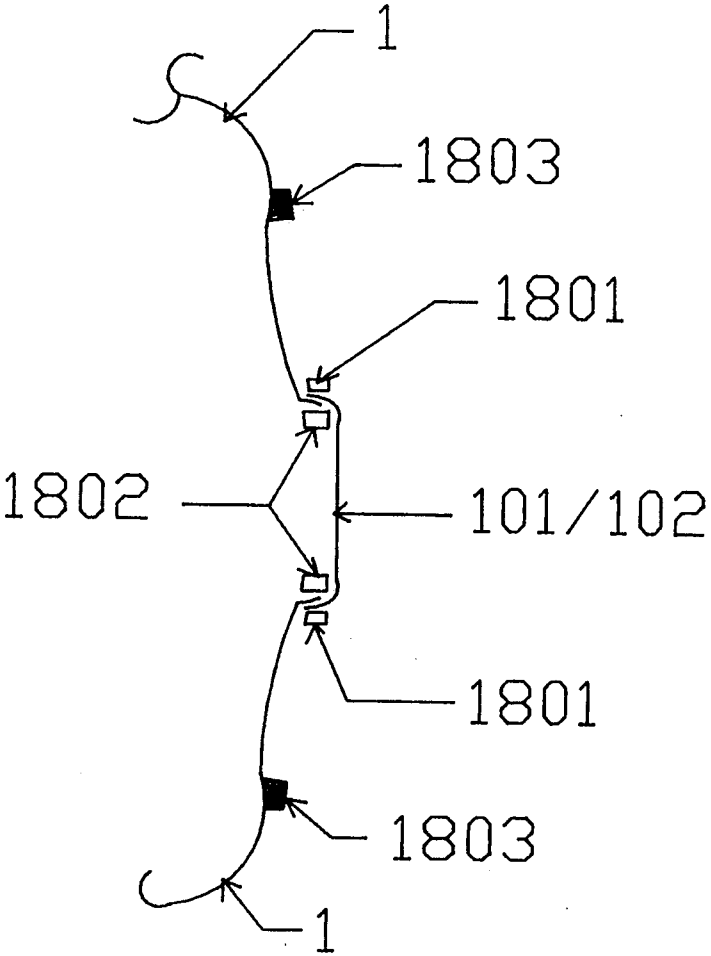
FIG. 18 is a crosssection view of a sealable opening of the Bag.
Figure 20:
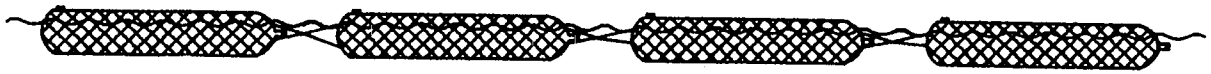
FIG. 20 shows a series of the Bag moving with a sea current. This figure shows one of the variations of the invented methods.
Figure 19:
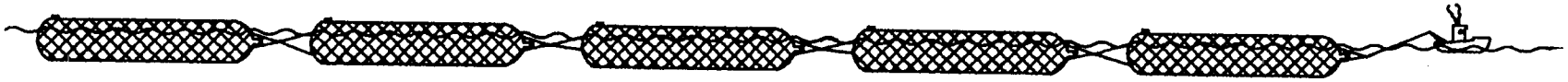
FIG. 19 shows a series of Bags being towed by a tug boat. This figure shows one of the variations of the invented methods.

A bag, the Bag, shown as 1 in Fig. 1, is made of any suitable flexible material. The Bag has at least two sealable openings, namely the Side Opening and the End Opening, shown as 101 and 102, respectively, in FIG. 1. (The Side Opening is at the side wall of the Bag.) The End Opening is near the center of one end wall of the Bag. FIG. 18 is a schematic of the crosssectional view of the openings. Each of the openings comprises a piece of membrane clamped onto the wall of the Bag by a set of rings, shown as 1801 and 1802, respectively, in FIG. 18. Float(s), shown as 1803 in FIG. 18, are made of light weight material and are be mounted onto the wall of the Bag. The float(s) will provide additional local buoyant forces to balance the weights of the rings so that the openings can float along with the rest of the Bag. The Bag shown in FIGS. 1 is inflated with air. The sea water surface is indicated as 100 in FIG. 1. The low density liquid or liquids or surface is indicated as 203 in FIG. 2.

Figure 12:
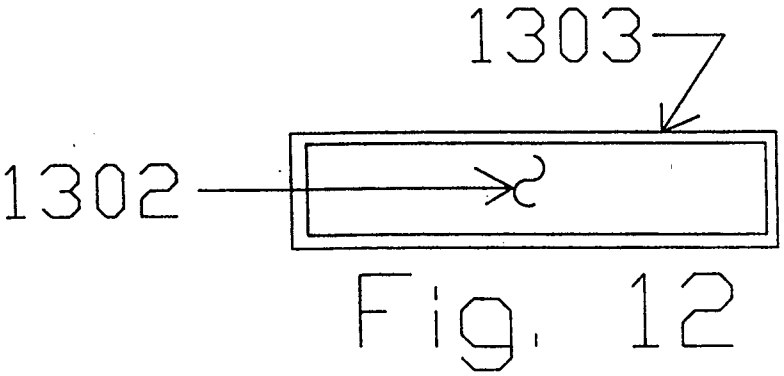
FIGS. 12, 13, and 14 show the top, elevation and side views, respectively, of the Filling Float.
Figure 13:
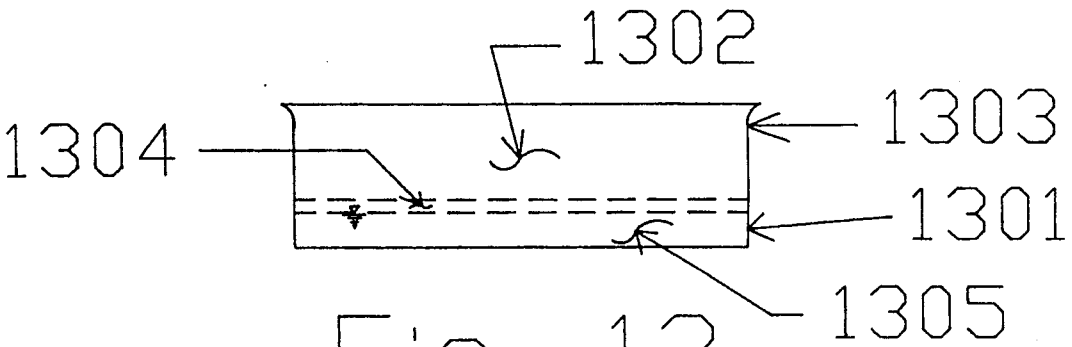
Figure 14:
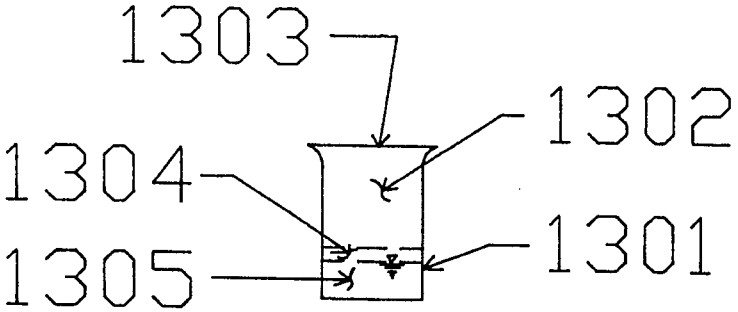

The Filling Float, shown as 13 in FIG. 1, basically is a submergible floating dock. FIGS. 12, 13, and 14 are the plan, elevation, and side views, respectively, of the schematic of the Filling Float. The Filling Float has a Bag Chamber, shown as 1302 in FIG. 13, above an Air Chamber, shown as 1301 in FIG. 13, below. Except at the top and the bottom, the sides of the Bag Chamber has either solid walls, net fences, rails, or other forms of walls which can confine the Bag in the Bag Chamber. These walls, fences, etc. can be stationary and/or removable and will have convex upper edges. Sea water in the Bag Chamber can be drained through the bottoms of these walls or fences. The Air Chamber, 1301, is a chamber with air (or gas) and sea water. The space occupied by air is called the Air Space, shown as 1304 in FIG. 13. The space occupied by the sea water is called the Water Space, shown as 1305 in FIG. 13. Changes of the buoyancy of the Filling Float can be made by adjusting the volume ratio between the Air Space and the Water Space. The changes of its buoyancy can make the Filling Float floating or submerging as in the case of a submarine boat.

Figure 4:
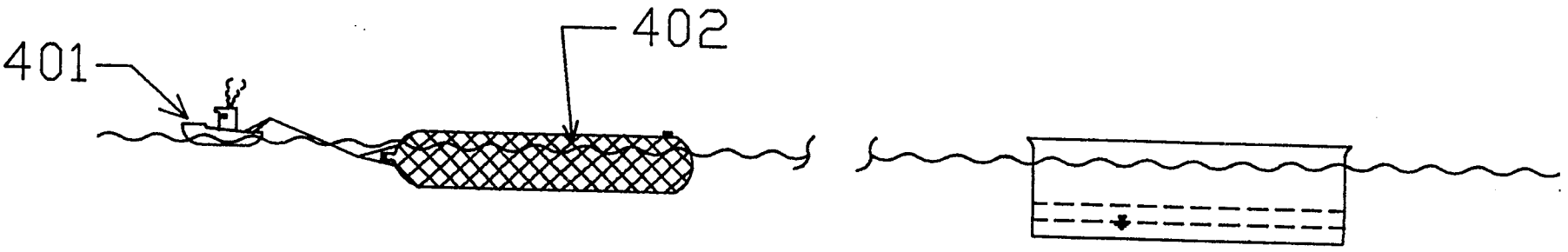
FIG. 4 shows the stage that the Bag is being towed away from the Filling Float to catch sea currents.

The Towing Net, shown as 402 in FIG. 4, is a net which can be put around the Bag when it is to be towed. The Towing Net can increase the strength of the Bag. The schematic of a tug boat is shown as 401 in FIG. 4.

Figure 7:
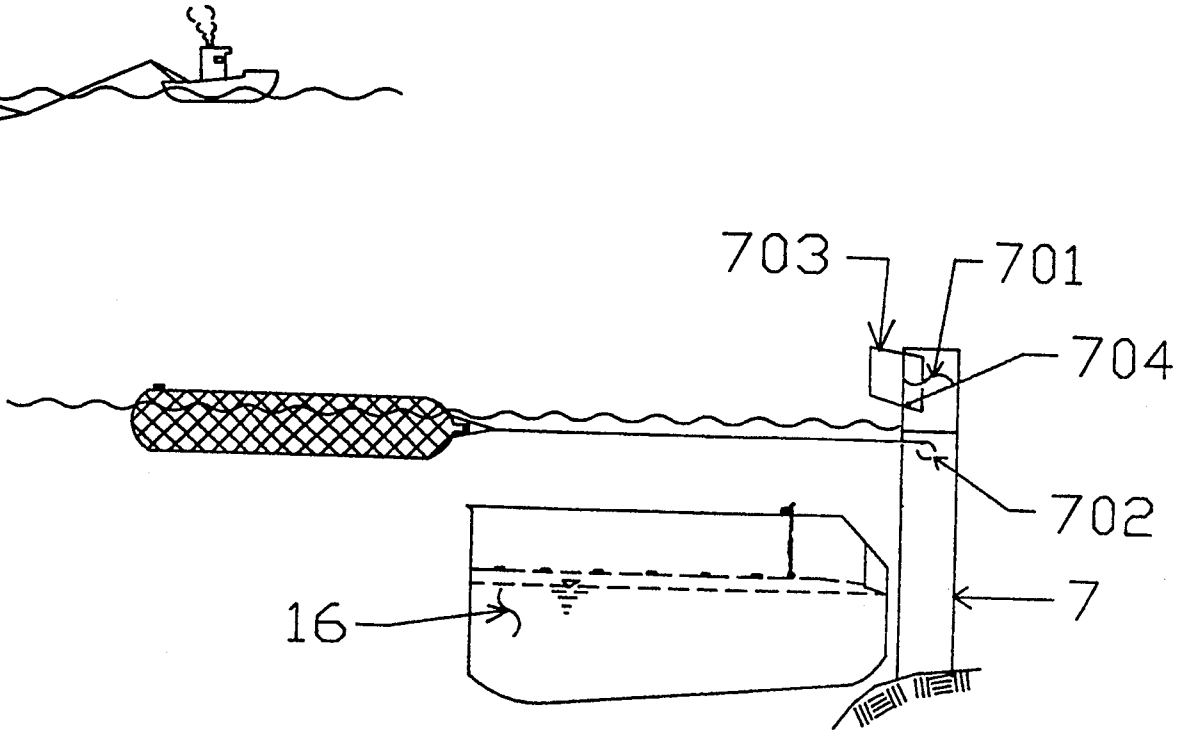
FIG. 7 shows the Bag and two other major components for the invented method. This schematic shows the stage wherein a Draining Float is sunk and the Bag is being pulled toward a Draining Tower for draining.
Figure 15:
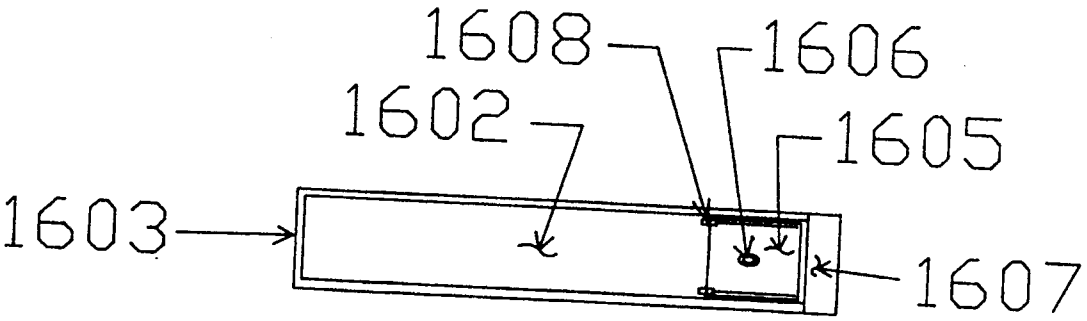
FIGS. 15, 16, and 17 show the top, elevation and side views, respectively, of the Draining Float.
Figure 16:
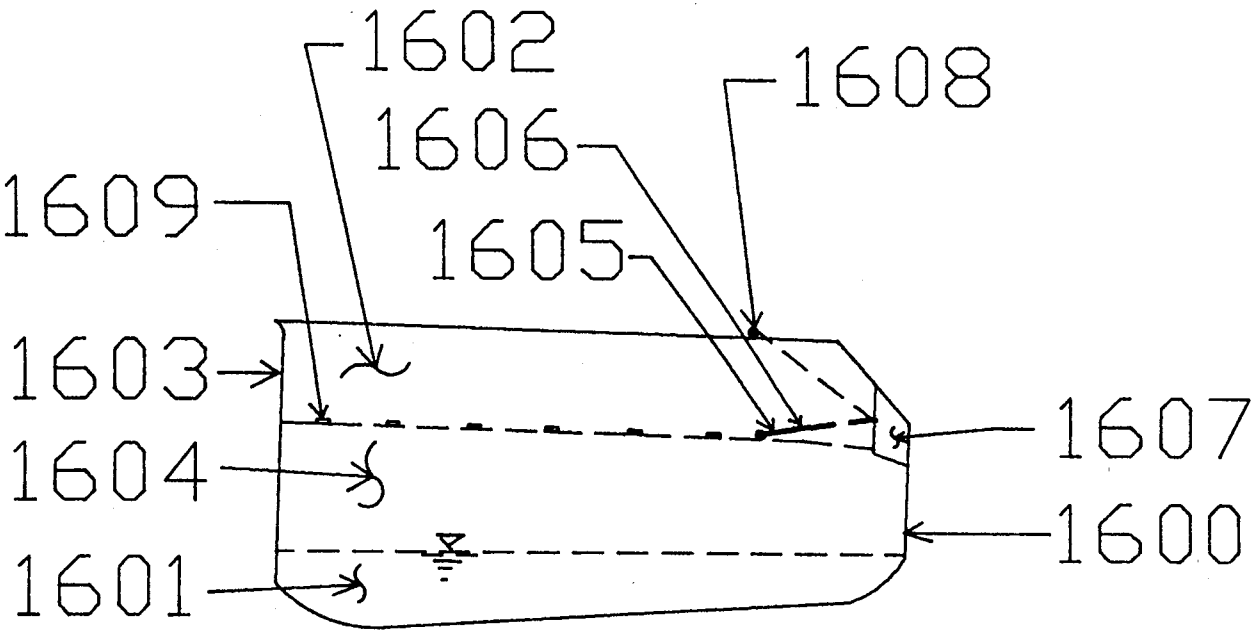
Figure 17:
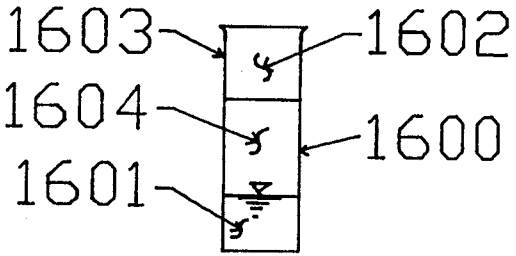

The Draining Float, shown as 16 in FIG. 7, basically is a submergible floating dock. FIGS. 15, 16, and 17 are the plan, elevation, and side views, respectively, of the schematic of the Draining Float. The Draining Float has a Draining Bag Chamber, shown as 1602 in FIG. 16, above and an Air Chamber, shown as 1600 in FIG. 16, below. Except at the top, the bottom, and one side (the Flapping Side which will be described later), the sides of the Draining Bag Chamber have either solid walls, net fences, rails, or other forms of walls, illustrated as 1603 in FIG. 16, which can confine the Bag in the Draining Bag Chamber. These walls, fences, etc. have convex upper edges. Sea water in the Draining Bag Chamber can be drained through the bottoms of the walls or fences. The Flapping Side, illustrated as 1605 in FIG. 16, is either a solid wall, a net fence, a rail wall, or other forms of wall which can support a wall of the Bag. The Flapping Side has an Opening 1606, FIG. 16, at about its center. The Opening 1606 has convex edges or rollers around its edges. The bottom of the Flapping Side is hinged onto to the bottom of the Draining Bag Chamber or near the bottom of the walls or fences 1603. The Flapping Side can be pivoted on its bottom hinge. The plumb position of the Flapping Side can be controlled by the pulley devices 1608 as illustrated in FIG. 16, or by some other levering devices. Near the far end of the Draining Bag Chamber and behind the Flapping Side, there is a Drop Chute, shown as 1607 in FIG. 16. The Drop Chute basically consists of two "U" shape conduits, one larger than the other. The two conduits are jointed together on the sides by two surfaces and on the bottoms by a drop step surface. The bottom of the Drop Chute is at about the same level of the bottom of the Draining Bag Chamber. The Drop Chute is made of liquid impervious material. The Air Chamber 1600 is a chamber (or several chambers) to store air (or gas) and sea water. The space occupied by the air is called the Air Space 1604, shown in FIG. 16. The space occupied by the sea water is called the Water Space 1601, shown in FIG. 16. Changes of the buoyancy of the Draining Float can be made by adjusting the volume ratio between the Air Space 1604 and the Water Space 1601. The changes of its buoyancy can make the Draining Float floating or submerged, as in the case of a submarine boat. Due to the shape of the Draining Float or due to the un-even ratios of many different Air Chambers 1600 of one Draining Float, the buoyancies at longitudinal ends of the Draining Float can be adjusted differently. Therefore, the bottom of the Draining Chamber can be sloped toward the Drop Chute.

The Draining Tower, shown FIG. 7, is either a floating or an anchored structure which has a Carrying Conduit, a Pulley System, and a Carrying Conduit Lip, shown as 701, 702, and 703, respectively, in FIG. 7. The Pulley System is a pulley system which can pull the Bag. The Carrying Conduit is a conduit which is connected with an ordinary conduit system to convey liquid which is drained from the Bag. The Carrying Conduit Lip is a conduit extending from the Carrying Conduit and is hinged on the Carrying Conduit. The hinge is shown as 704 in FIG. 7. The width across the interior surfaces of the walls of the Carrying Conduit Lip is the same as that of the smaller "U" shape conduit of the Drop Chute. The lower extent of the Carrying Conduit Lip can be set flush with the bottom of the smaller "U" shape conduit of the Drop Chute. When joined together, the Carrying Conduit Lip and the Drop Chute form a conduit to convey liquid from the Bag to the Carrying Conduit. When the Drop Chute is raised higher, the Carrying Conduit Lip will pivot on its hinge and will still form a conduit but with larger slope.

Figure 2:
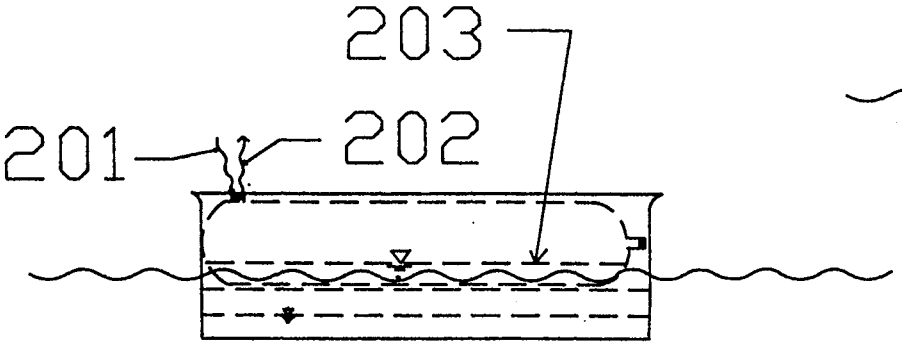
FIG. 2 shows the stage that the Bag is inside the Filling Float for filling with low density liquids.

To start the method of transportation of low density liquids, firstly the Bag is placed inside of the Bag Chamber of the Filling Float. All of its openings are then sealed up, except the Side Opening(s). Then, the Bag is filled with low density liquids. The filling can be done by letting low density liquids into and air out of the Bag simultaneously at the Side Opening, as shown in FIG. 2. The numbers 201 and 202 indicate the liquid in and the air out of the Bag, respectively. The filling can also be done by letting low density liquids into the Bag from one Side Opening and air out of the Bag from another Side Opening. The Bag can be inflated before the filling to ensure the room for low density liquids. Or, the Bag can be equipped with some floats on its upper walls and some weights on its lower walls. The floats will raise the upper walls and the weights will lower the lower walls. Therefore, proper room in the Bag can be maintained in the progress of filling.

Figure 3:
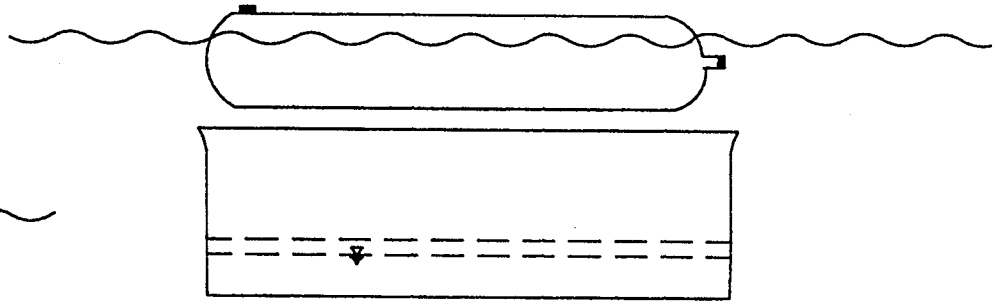
FIG. 3 shows the stage that the Bag is filled with low density liquids and is separated from the Filling Float which was ballasted and sank.
Figure 5:
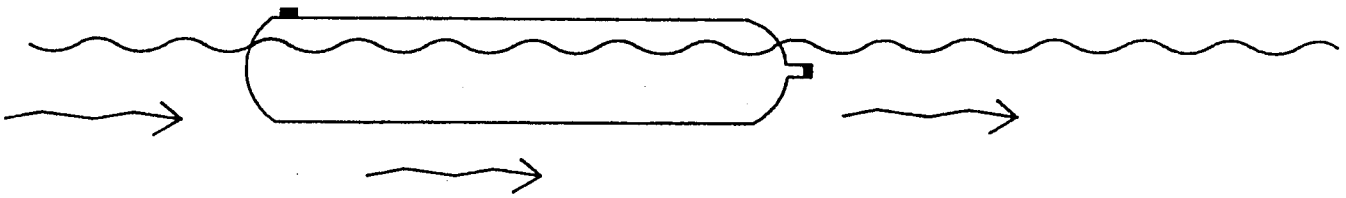
FIG. 5 shows the stage that the Bag is floating with sea currents toward near its destination.

After more liquid is filled into the Bag, the walls or fences of the Filling Float will confine and support the Bag. When the Bag is filled with the low density liquids, the Filling Float is ballasted and the Bag will be floated on the sea water. The convex upper edges of the walls or fences of the Bag Chamber will prevent the Bag from being torn apart when it is floating upward from the Bag Chamber. As mentioned earlier, the degree of submergence of the Bag depends on the design, material and construction of the Bag. In general, the more floats the Bag has, the less will its submergence be. When the Bag is floating on the sea, the sea water and the strength of the bag material will support and maintained the integrity of the Bag. FIG. 3 illustrates this interim condition of the method. A Towing Net as at 402 is then attached around the Bag to increase its strength for towing. A tug boat will tow the Bag to a place so that the Bag can catch a sea current. FIG. 4 illustrates this condition. The Towing Net then can be removed from the Bag. The removal of the Towing Net is optional to this invented method. FIG. 5 shows the Bag floating with the sea current.

Figure 6:
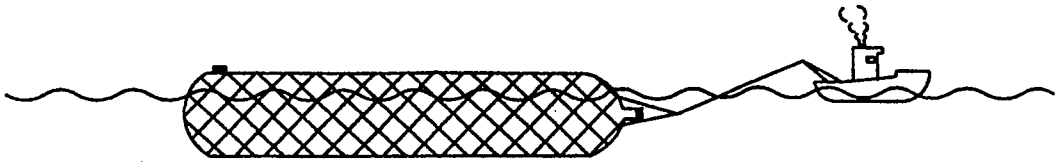
FIG. 6 shows the stage that the Bag is being towed away from sea currents toward its final destination.
Figure 8:
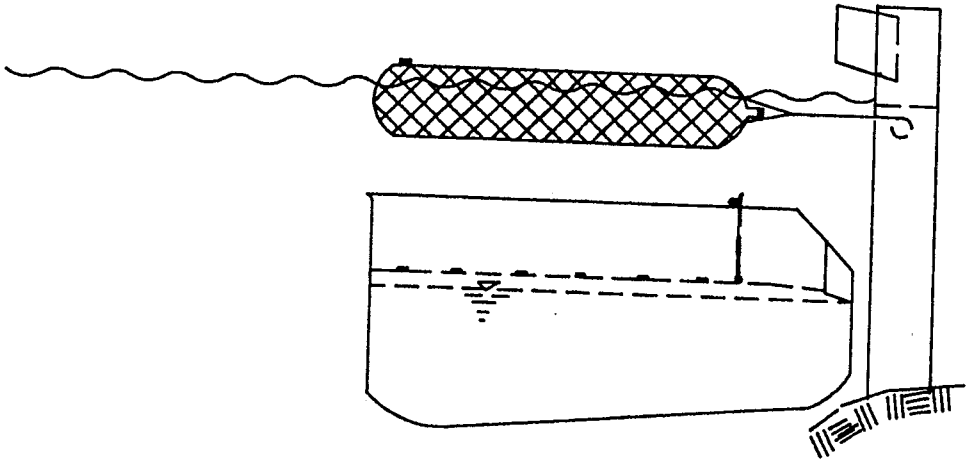
FIG. 8 shows the stage that the Bag is in the position to be picked up by the Draining Float for draining.
Figure 11:
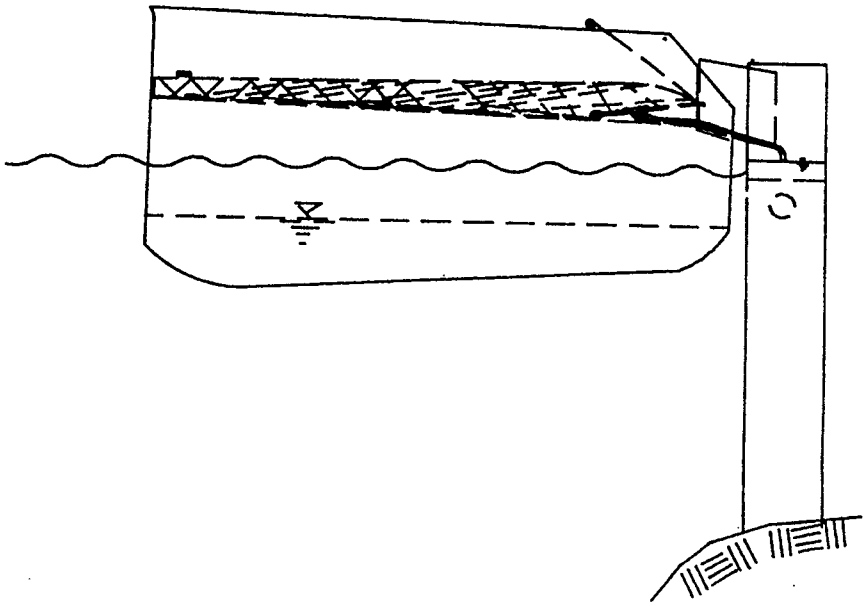
FIG. 11 shows that the Bag is near its final stage of draining.
Figure 10:
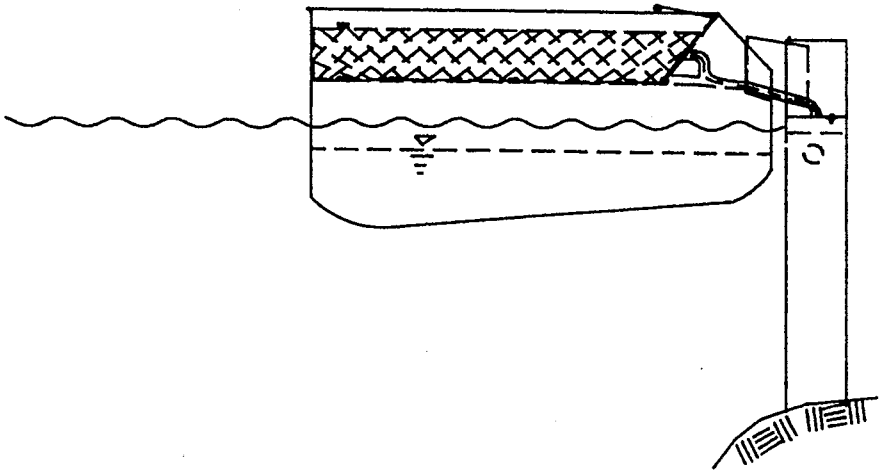
FIG. 10 shows the stage that the Bag is in the initial stage of being drained.

When its arrives near its destination, the Bag is mounted with a Towing Net again, if the previous mounted net is removed already. A tug boat can tow the Bag away from the sea current and closer to the Draining Float and the Draining Tower, as illustrated in FIG. 6. The Pulley System of the Draining Tower can pull the Bag to the Draining Tower where the Draining Float is located, as shown in FIGS. 7 and 8.

As mentioned earlier, the walls or fences of the Draining Bag Chamber are either solid walls, net fences rails, operable gates, or other forms of walls which can confine and support the Bag. For the Draining Float with operable gates for its Draining Bag Chamber, the Draining Float needs not to be fully submergible. For the Draining Float with other type of fences or walls for its Draining Bag Chamber, the Draining Float generally needs to be fully submergible.

Figure 9:
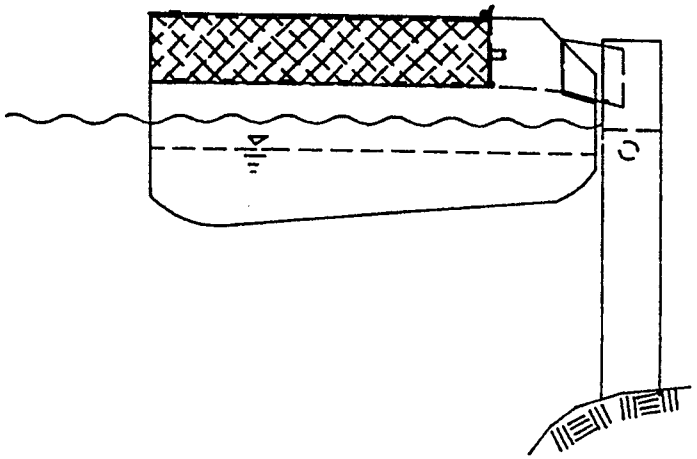
FIG. 9 shows the stage that the Bag is inside a de-ballasted Draining Float and ready for draining. Note that the Bag is raised above the sea level by the de-ballasted Draining Float.

When the Bag is in or above the Draining Bag Chamber, depending on the required submergence of the Draining Float, the Towing Net is then removed. This removal can be optional. The Flapping Side will be tilted up approximately vertically and the operable gates, if applicable, of the Draining Bag Chamber will be closed. Then, the Draining Float will be somewhat de-ballasted and the position of the Flapping Side of the Draining Bag Chamber will be adjusted so that the End Opening of the Bag extends out of the Draining Bag Chamber at the Opening 1606 of the Flapping Side. Then, the Draining Float will be more de-ballasted so that the Drop Chute is above sea waves, as shown in FIG. 9. At this time, no sea water will remain in the Draining Bag Chamber nor the Drop Chute. In FIG. 9, the Towing Net is not removed. The larger "U" shape conduit of the Drop Chute will be under the Carrying Conduit Lip to form a flow conduit. The End Opening of the Bag will be cut or unsealed to let the low density liquids flow out from the Bag.

During the de-ballasting and the rising of the Draining Float, the remaining sea water in the Draining Bag Chamber is drained through the walls, gates, fences, etc. of the Draining Bag Chamber and the supporting forces to the Bag are gradually transferred from the sea water to the Flapping Side and walls, fences, or gates of the Draining Bag Chamber.

During draining, the Flapping Side can be tilted down to lower the End Opening to ensure that liquid is drained out of the Bag. As mentioned earlier, the bottom of the Draining Bag Chamber can be sloped by de-ballasting the Draining Float to create uneven buoyant forces across its two longitudinally ends. This can also ensure proper slopes to drain the low density liquids from the Bag. In FIGS. 10 and 11, 1001 and 1101 respectively indicate that the low density liquids are flowing out of the Bag into the Draining Tower.

Many variations can be derived from the above method. One variation is that the Bag can be inflated and filled with low density liquids in the sea without the use of the Filling Float. Another variation is that the Bag can be drained by pumping instead of using the Draining Float. There are other variations such as, instead of being transported by the sea currents, the Bags can be lumped together and be towed by a tug boat or a number of tug boats. Signal devices can be mounted on a Bag to indicate its location on the globe.

The foregoing is considered as illustrative only of the principles of the invention. Furthermore, since numerous modifications and changes will readily occur to those skills in the art, it is not desired to limit the invention to the exact construction and operation shown and described, and accordingly all suitable modifications and equivalents may be restored to, falling within the scope of the invention as claimed.

We claim:

1. A method of transporting low density liquids across oceans, the method comprising:

providing a Bag and a Filling Float having a Bag Chamber; placing the Bag inside the Bag Chamber of the Filling Float near a source of low density liquids; said low density liquid having density lower than that of sea water; said Bag being a bag with three sealable openings; two of said openings being Side Openings on a side wall of said Bag; the third said opening being an End Opening near the center of one end wall of said Bag; at least one Opening being a membrane clamped by ring means onto said Bag; said Side Openings and End Opening being surrounded by floats; said floats being made of material lighter than sea water and being mounted on the walls of said Bag; said Filling Float being a vessel which can be ballasted and de-ballasted;

sealing up said End Opening of said Bag and un-sealing said Side Openings;

filling up said Bag with low density liquid to be transported;

sealing up said Side Openings of said Bag;

ballasting said Filling Float to let said Bag float alone;

putting a Towing Net around said Bag; said Towing Net being a net capable of strengthening said Bag;

towing said Bag to open sea to catch an ocean current;

releasing said Bag and allowing said Bag to drift;

repeating the last two steps until said bag arrives proximate its destination;

providing a Draining Float;

towing said Bag to near said Draining Float; said Draining Float being a vessel able to be ballasted and de-ballasted and which has a Draining Bag Chamber on its top; said Draining Float being able to provide uneven buoyant forces longitudinally; said Draining Bag Chamber being a space having a Flapping Side and walls having convex upper edges; said Flapping Side being a wall hinged to solid parts of said Draining Float; said Flapping Side having an opening; there being curved edges around said opening of said Flapping Side;

pulling said Bag over said Draining Bag Chamber of said Draining Float;

de-ballasting said Draining Float to let said Bag rest into said Draining Bag Chamber; meanwhile, tilting up said Flapping Side and allowing said End Opening of said Bag to penetrate through said opening said Flapping Side; stopping de-ballasting of said Draining Float;

opening said End Opening of said Bag to drain said bag; and adjusting periodically the buoyancy of said Draining float and the position of said Flapping Side to drain said Bag.

2. A method of transporting low density liquids across oceans, the method comprising:

placing a Bag near a source of low density liquid; said low density liquid having density lower than that of sea water; said Bag being a bag with two sealable Side Openings; said Side Openings being on a side wall of said Bag; each said Side Opening being a membrane clamped by two rings onto said Bag; said Side Opening being surrounded by floats; said floats being made of material lighter than sea water and being mounted on the walls of said Bag;

un-sealing said Side Openings of said Bag;

filling up said Bag with low density liquid to be transported;

sealing up said Side Openings of said Bag;

putting a Towing Net around said Bag; said Towing Net being a net capable of strengthening said Bag;

towing said Bag to open sea to catch an ocean current;

releasing said Bag and allowing said Bag to drift;

repeating the last two steps until said Bag reaches its destination;

un-sealing at least one of said Side Openings;

removing said low density liquid from said Bag.

3. A method of transporting low density liquids across oceans, the method comprising:

providing a Bag and a Filling Float having a Bag Chamber;

placing the Bag inside the Bag Chamber of the Filling Float near a source of low density liquid; said low density liquid having density lower than that of sea water; said Bag being a bag with three sealable openings; two of said openings being Side Openings on a side wall of said Bag; the third said opening being an End Opening near the center of one end wall of said Bag; at least one Opening being a membrane clamped by ring means onto said bag; said Side Openings and End Opening being surrounded by floats; said floats being made of material lighter than sea water and being mounted on the walls of said Bag; said Filling Float being a vessel which can be ballasted and de-ballasted;

sealing up said End Opening of said Bag and un-sealing said Side Openings;

filling up said Bag with low density liquid to be transported;

sealing up said Side Openings of said Bag;

ballasting said Filling Float to let said Bag float alone;

putting a Towing Net around said Bag; said Towing Net being a net capable of strengthening said Bag;

chaining up a number of said Bags prepared by the above six steps by tying up said Towing Net together;

towing the chain of said Bags to open sea to catch an ocean current;

releasing the chain of said Bags and allowing said Bags to drift;

repeating the last two steps until the chain of said Bags arrives near its destination;

un-chaining said Bags as needed for the steps below;

providing a Draining Float;

towing an un-chained said Bag to near said Draining Float; said Draining Float being a vessel able to be ballasted and de-ballasted and which has a Draining Bag Chamber on its top; said Draining Float being able to provide uneven buoyant forces longitudinally; said Draining Bag Chamber being a space having a Flapping Side and walls having convex upper edges; said Flapping Side being a wall hinged to solid parts of said Draining Float; said Flapping Side having a opening; there being curved edges around said opening of said Flapping Side;

pulling the un-chained said Bag over said Draining Bag Chamber of said Draining Float;

de-ballasting said Draining Float to let the un-chained said Bag rest into said Draining Bag Chamber; meanwhile, tilting up said Flapping Side and allowing said End Opening of said Bag to penetrate through said opening of said Flapping Side; stopping deballasting of said Draining Float;

opening said End Opening of the un-chained said Bag to drain said Bag; and adjusting periodically the buoyancy of said Draining Float and the position of said Flapping Side to drain the un-chained said Bag.

4. A method of transporting low density liquids across oceans, the method comprising:

providing a Bag and a Filling Float having a bag chamber;

placing the Bag inside the Bag Chamber of the Filling Float near a source of low density liquid; said low density liquid having density lower than that of sea water; said Bag being a bag with three sealable openings; two of said openings being Side Openings on a side wall of said Bag; the third said opening being an End Opening near the center of one end wall of said Bag; at least one Opening being a membrane clamped by ring means onto said Bag; said Side Openings and End Opening being surrounded by floats; said floats being made of material lighter than sea water and being mounted on the walls of said Bag; said Filling Float being a vessel which can be ballasted and de-ballasted;

sealing up said End Opening of said Bag and un-sealing said Side Openings;

filling up said Bag with low density liquid to be transported;

sealing up said Side Openings of said Bag;

ballasting said Filling Float to let said Bag float alone;

putting a Towing Net around said Bag; said Towing Net being a net capable of strengthening said Bag;

chaining up a number of said Bags prepared by the above six steps by tying up said Towing Net together;

towing the chain of said Bags to near their destinations;

un-chaining said Bags as needed for the steps below;

providing a Draining Float;

towing an un-chained said Bag to near said Draining Float; said Draining Float being a vessel able to be ballasted and de-ballasted and which has a Draining Bag Chamber on its top; said Draining Float being able to provide uneven buoyant forces longitudinally; said Draining Bag Chamber being a space having a Flapping Side and walls having convex upper edges; said Flapping Side being a wall hinged to solid parts of said Draining Float; said Flapping Side having an opening; there being curved edges around said opening of said Flapping Side;

pulling the un-chained said Bag over said Draining Bag Chamber of said Draining Float;

de-ballasting said Draining Float to let the un-chained said Bag rest into said Draining Bag Chamber; meanwhile, tilting up said Flapping Side and allowing said End Opening of said Bag to penetrate through said opening of said Flapping Side; stopping deballasting of said Draining Float;

opening said End Opening of the un-chained said Bag to drain said Bag; and adjusting periodically the buoyancy of said Draining Float and the position of said Flapping Side to drain the un-chained said Bag.

* * * * *